US006220736B1

(12) United States Patent
Dobler et al.

(10) Patent No.: US 6,220,736 B1
(45) **Date of Patent: *Apr. 24, 2001**

(54) HEADLIGHT FOR A VEHICLE

(75) Inventors: Karl-Otto Dobler; Kurt Schuster; Juergen Wulf; Andreas Schien; Klaus Nagel, all of Reutlingen; Doris Boebel, Stuttgart, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/112,893

(22) Filed: Jul. 9, 1998

(30) Foreign Application Priority Data

Jul. 10, 1997 (DE) ..... 197 29 478
Apr. 1, 1998 (DE) ..... 198 14 478

(51) Int. Cl.[7] ..... F21V 7/00; F21V 5/00

(52) U.S. Cl. ..... 362/539; 362/520; 362/329; 362/346; 359/742

(58) Field of Search ..... 362/300, 309, 362/329, 338, 520, 538, 539, 342, 346, 332; 359/457, 742

(56) References Cited

U.S. PATENT DOCUMENTS 4,158,222 * 6/1979 Cook ..... 362/269
4,814,950 * 3/1989 Nakata ..... 362/61
4,949,226 * 8/1990 Makita et al. ..... 362/61
5,023,758 * 6/1991 Allen et al. ..... 362/61

FOREIGN PATENT DOCUMENTS 32 18 703 A1 11/1983 (DE) .
3218703 A1 11/1983 (DE) .

* cited by examiner

*Primary Examiner*—Cassandra Spyrou
*Assistant Examiner*—Jared Treas
(74) *Attorney, Agent, or Firm*—Michael J. Striker

(57) ABSTRACT

A headlight for a vehicle has a reflector, a light source, a lens through which a light reflected by the reflector passes, and at least one element which surrounds the lens at least over a part of its periphery and is at least partially light permeable so that the light emitted by the light source and not engaged by the reflector passes through the element and is collected, the element being provided with ring-shaped optical profiles which form a Fresnel lens.

15 Claims, 6 Drawing Sheets

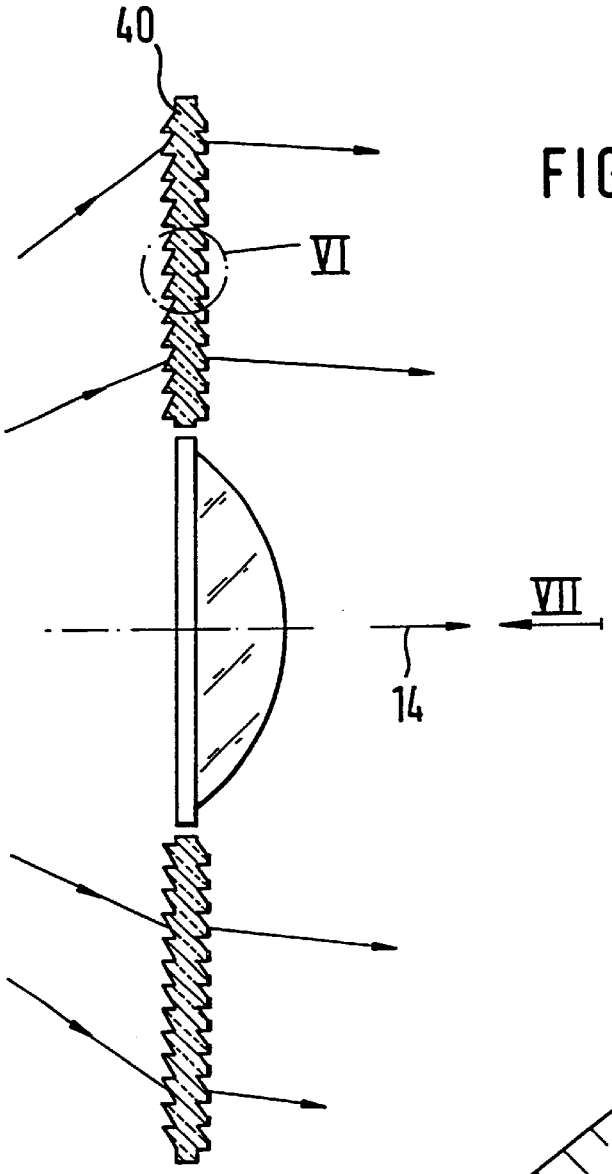
FIG. 5
FIG. 6
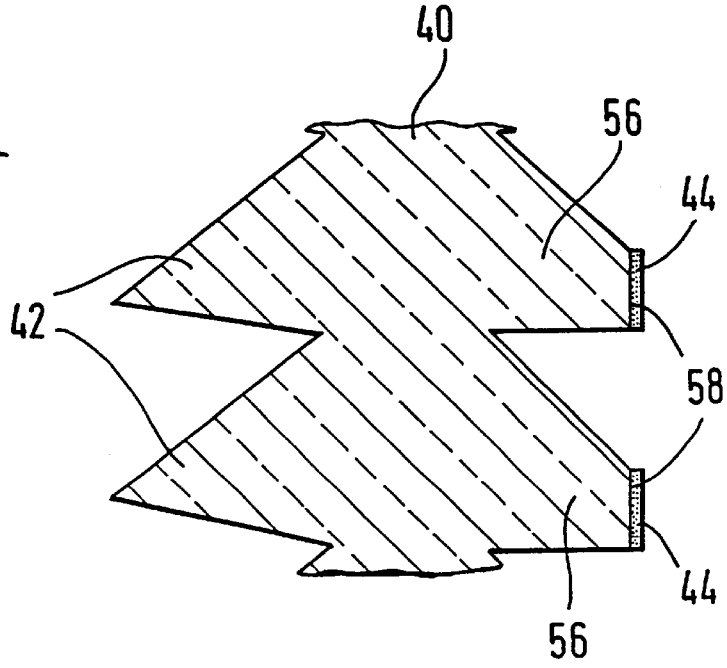

HEADLIGHT FOR A VEHICLE

BACKGROUND OF THE INVENTION

The present invention relates to headlights for vehicles.

One of such headlights is disclosed for example in the German patent document DE 32 18 703 A1. This headlight has a reflector, a light source, a lens through which the light reflected by the reflector passes. Moreover, the headlight has a light permeable element which surrounds the lens at least over a part of its periphery, so that the light emitted by the light source and not caught by the reflector can pass and be reflected. For this purpose the element has prisms which deviate the passing light. With this design of the element, when the light source is turned on, the illuminated surface of the reflector relative to the surface of the lens increases, so that no or a little subjective blinding is caused by the reflector. When the light source is turned off, the element becomes dark and the headlight has an undesirable, non uniform appearance. Moreover, with the prisms of the element, only a part of the light passing through the element can be captured.

SUMMARY OF THE INVENTION

Accordingly, it is an object of the present invention to provide a headlight for vehicles which avoids the disadvantages of the prior art.

In keeping with these objects and with others which will become apparent hereinafter, one feature of present invention resides, briefly stated in a headlight for a vehicle, in which the element is formed at least locally as a Fresnel lens with ring-shaped optical profiles.

When the headlight is designed in accordance with the present invention, the light emitted by the light source, due to the design of the element as a Fresnel lens, is collected during passage through the element with high efficiency.

In accordance with a feature of present invention, the headlight in the turned off position has a brilliant appearance. Due to the collecting action of the fresnel lens, despite the partial screening of the light passing through the element, because of the layer a sufficient illumination of the region around the lens is obtained.

In accordance with still a further feature of present invention a coating can be applied on the profile in a simple manner without covering the entire surface of the element by the coating.

In accordance with still a further feature of the present invention, the distribution of the light passing through the element can be influenced.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a view showing a section of the headlight in a vertical longitudinal section in accordance with a fourth embodiment of the invention;

FIG. 6 is a view showing a portion of the headlight of FIG. 5 identified with reference numeral 5;

DESCRIPTION OF PREFERRED EMBODIMENT

Figure 1:
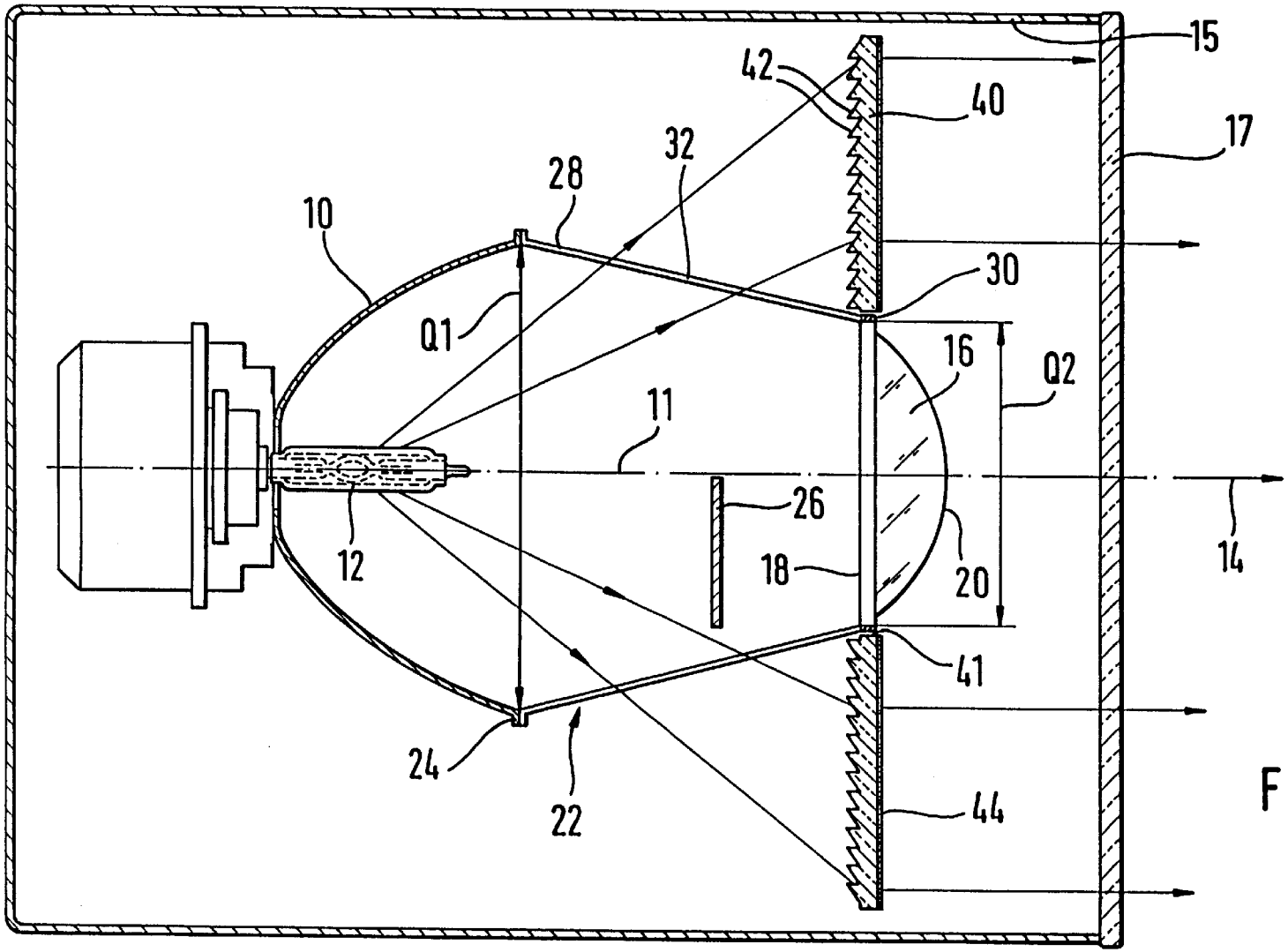
FIG. 1 is a view showing a headlight in a vertical longitudinal section in accordance with a first embodiment of the present invention.

A headlight for vehicles shown in FIGS. 1–9, and in particular for motor vehicles, is formed preferably in accordance with a projection principle and serves for producing at least one dim light. The headlight has a reflector 10 composed of a synthetic plastic material or metal. A light source 12 is inserted in its apex region. The light source 12 can be an incandescent lamp, a gas discharge lamp, or another suitable lamp. As seen in a light outlet direction 14, a lens 16 composed of glass or synthetic plastic material is arranged after the reflector 10. The lens for example has a flat side 18 facing the reflector 10 and a convex curved side 20 which is opposite to the flat side. The lens 16 is held in a supporting element 22 which can be connected with a front edge 24 of the reflector 10 facing in the light outlet direction 14. The reflector 10 and the lens 16 can be arranged in a housing 15 provided with a light outlet opening. The light outlet opening is covered 15 by a light-permeable member 17 which can be formed as a disk and composed of glass or synthetic plastic material. The cover member 17 can be smooth so that the light passes through it without being affected. Alternatively, it can be provided at least locally with optical elements which deviate the light passing through it, for example disperse the light.

The light emitted by the light source 12 is reflected by the reflector 10 as a converging light bundle which passes through the lens 16 and thereby is deviated. The lens 16 is formed as a collecting lens, and the light passing through it is refracted to the optical axis 11 of the reflector 10. The reflector 10 can have at least approximately an ellipsoidal shape, and ellipsoid-like shape or a numerically determined shape which is derived from the characteristic of the light bundle to be reflected by the reflector 10. A light-permeable orifice 26 can be arranged between the reflector 10 and the lens 16, which is arranged substantially under the optical axis 11, so that only a part of the light bundle reflected by the reflector 10 passes along it. The light bundle passing on the orifice 26 contains a bright-dark limit determined by the upper edge of the orifice 26. It is formed by the lens 16 as the bright-dark limit of the dim light bundle exiting the headlight. Alternatively, the orifice 26 can be dispensed with when the shape of the reflector 10 is determined so that the light bundle reflected by it already has the required bright-dark limit formed for the lens 16.

The reflector 10 at its front edge 24 has a cross-section Q1, and the lens 16 has a smaller cross-section Q2 opposite to the cross-section Q1. The supporting element 22 can have one or several webs 28 which extend starting from the front edge 24 of the reflector 10 to the proximity of the lens 16, where they can be connected with one another, for example by a ring-shaped portion 30 in which the lens 16 is held with its edge. Openings 32 are left between the webs 28 so that the light emitted by the light source 12 and not captured by the reflector 10 can pass through them. The webs 28 preferably are formed as small as possible to maintain great openings 32 between them so that a corresponding great part of the light emitted by the light source 12 can pass through them.

In accordance with the present invention, at least one element 40 which surrounds the lens 16 at over a part of its periphery is provided. In FIGS. 1–8 it is shown in various embodiments. All embodiments have the same feature that the element 40 is composed of a light permeable material, for example glass or synthetic plastic material. The element 40 is at least locally, preferably over its total extension, is formed as a Fresnel lens and has a plurality of ring-shaped, approximately concentric, optically active profiles 42. The optical profiles 42 can be arranged at the side of the element 40 which faces the reflector 10 as shown in FIGS. 1–5. On the other hand, the optical profiles can be arranged on the side of the element 40 which faces in the light outlet direction 14 and away from the reflector 10. The optical profiles 24 are formed preferably wedge-shaped. The light passing through the element 40 is deviated by the optical profiles toward the optical axis 11 and thereby collected. The optical profiles 42 can be formed for example so that the light emitted by the light source 12 after passage through them extends substantially parallel to the optical axis 11. The element 40 can be arranged, as shown in FIG. 1, so that it has substantially the same distance from the reflector 10 as the lens 16 in direction of the optical axis 11. Alternatively, the element 40 has another distance in direction of the optical axis 11 from the reflector 10 than the lens 16, and thereby is offset relative to the lens 16.

In the shown embodiments, the optical profiles 42 for forming the Fresnel lens are arranged on the side of the element 40 which faces toward the reflector 10. The element 40 has an opening 41 for passage of the lens 16. In the first embodiment shown in FIG. 1, the element 40 is formed substantially flat and at its side facing the light outlet direction 40 is substantially smooth. Alternatively, the profiles 42 can be arranged for forming the Fresnel lens also on the side of the element 40 facing in a light outlet direction 14, while the side of the element 40 facing the reflector 10 is substantially smooth.

In accordance with a further embodiment of the headlight, at least partially reflecting coating 44 can be applied at least locally on the side of the element 40 which faces in the light outlet direction 14. The coating 44 can be formed so that it is light-impermeable, and then it is arranged only in some regions on the element 40 to make possible a partial passage of the light emitted by the light source 12. The coating 44 can be formed by lines or rings. The light impinging from outside on the coating 44 is reflected by it.

Alternatively, the coating 44 can be formed so that it is partially light permeable and partially reflecting. In this case, the total surface of the element 40 is covered by the coating 44, or only a part of this surface. The light emitted by the light source 20 can pass partially through the coating 44, while the light impinging from outside on the coating 44 is partially reflected. The element 40 is arranged substantially at the same distance from the reflector 10 as the lens 16. The coating 44 is composed preferably of metal, for example aluminum and can be applied with known methods on the element 40, for example by the evaporation, sputtering, varnishing, printing or impregnating. The light permeability of the coating 44 can be varied by its thickness, and its light permeability can reduce with increasing thickness. For obtaining a partial light permeability of the coating 44, it is formed with a small thickness, while for obtaining a high reflection degree it is formed with a correspondingly greater thickness.

Figure 2:
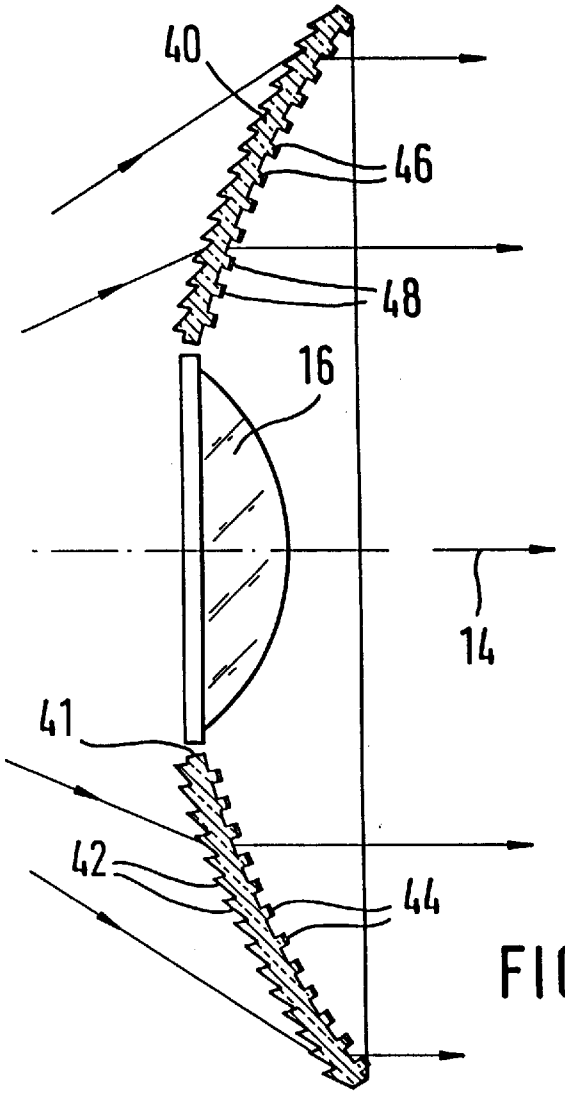
FIG. 2 is a view showing a section of the headlight in a vertical longitudinal section in accordance with a second embodiment of the invention.

The element 40 is shown in FIG. 2 in accordance with a second embodiment of the invention. Here, the element 40, contrary to the first embodiment, is not flat but instead concavely curved. The element 40 has also the opening 41 for passage of the lens 16. In the region of its opening 41, the element 40 has substantially the distance from the reflector 10 as the lens 16, and starting from the lens 16 extends farther in the light outlet direction 14. The value of the curvature of the element 40 can be selected in correspondence with the space conditions in the headlight and the desired appearance of the headlight. The element 40 has the optical profiles 42 provided on its side facing the reflector 10 for forming the Fresnel lens. At its side facing in the light outlet direction 14, it has raised profiles 46. The profiles 46 can be formed for example rectangular and provided with sides which face in the light outlet direction 14 and have flattenings 48.

A coating 44 can be applied on the element 40. It can be applied for example on the flattenings 48 of the profiles 46 of the element 40 facing in the light outlet direction 14. The regions of the element 40 remaining between the profiles 46 are not provided with the coating 44. The coating 44, similarly to the first embodiment, can be reflecting, or partially reflecting and partially light-permeable and applied in the same way. The profiles 46 can be also provided as in the first embodiment on the flat element 40, while the concavely curved element 40 of the second embodiment can be also smooth, or in other words formed without the profiles 46.

Figure 3:
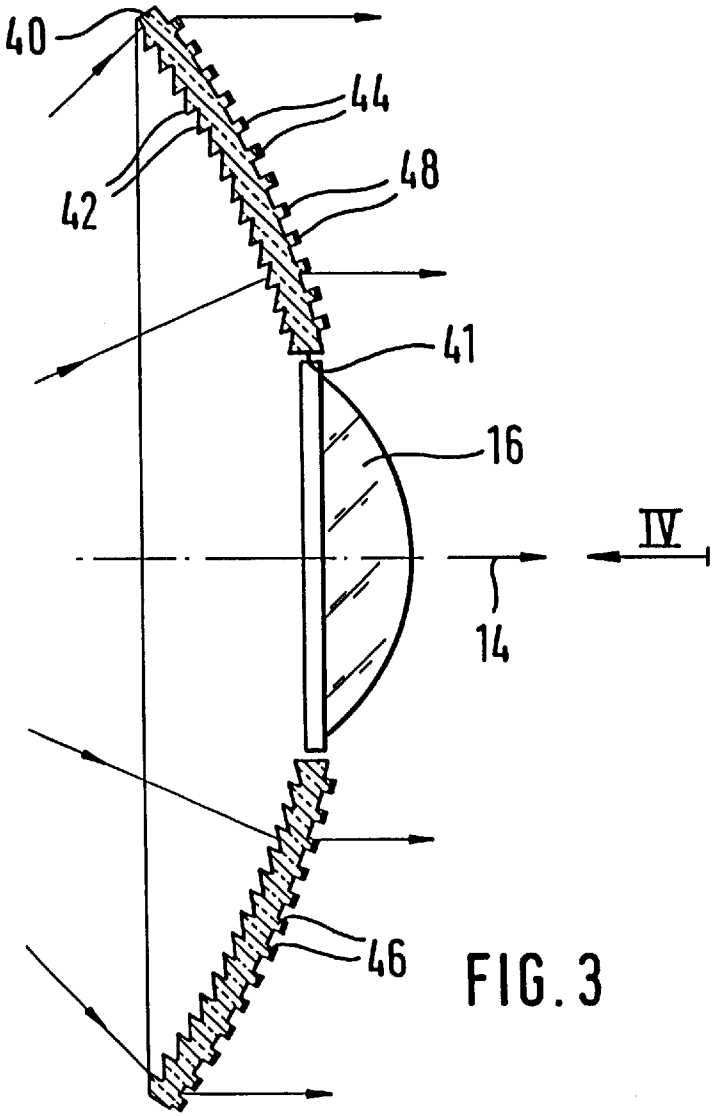
FIG. 3 is a view showing a section of the headlight in a vertical longitudinal section in accordance with a third embodiment of the present invention.

A third embodiment of the element 40 is shown in FIG. 3. In contrast to the second embodiment, it is concavely curved, while the remaining design of the element 40 is the same as in the second embodiment. The element 40 in the region of its opening 41 for the lens 16 has substantially the same distance from the reflector 10 as the lens 16, and extends starting from the lens 16 opposite to the light outlet direction 14. Here also the curvature of the element 40 is selected so that a desired appearance of the headlight when looked from outside is provided.

Figure 4:
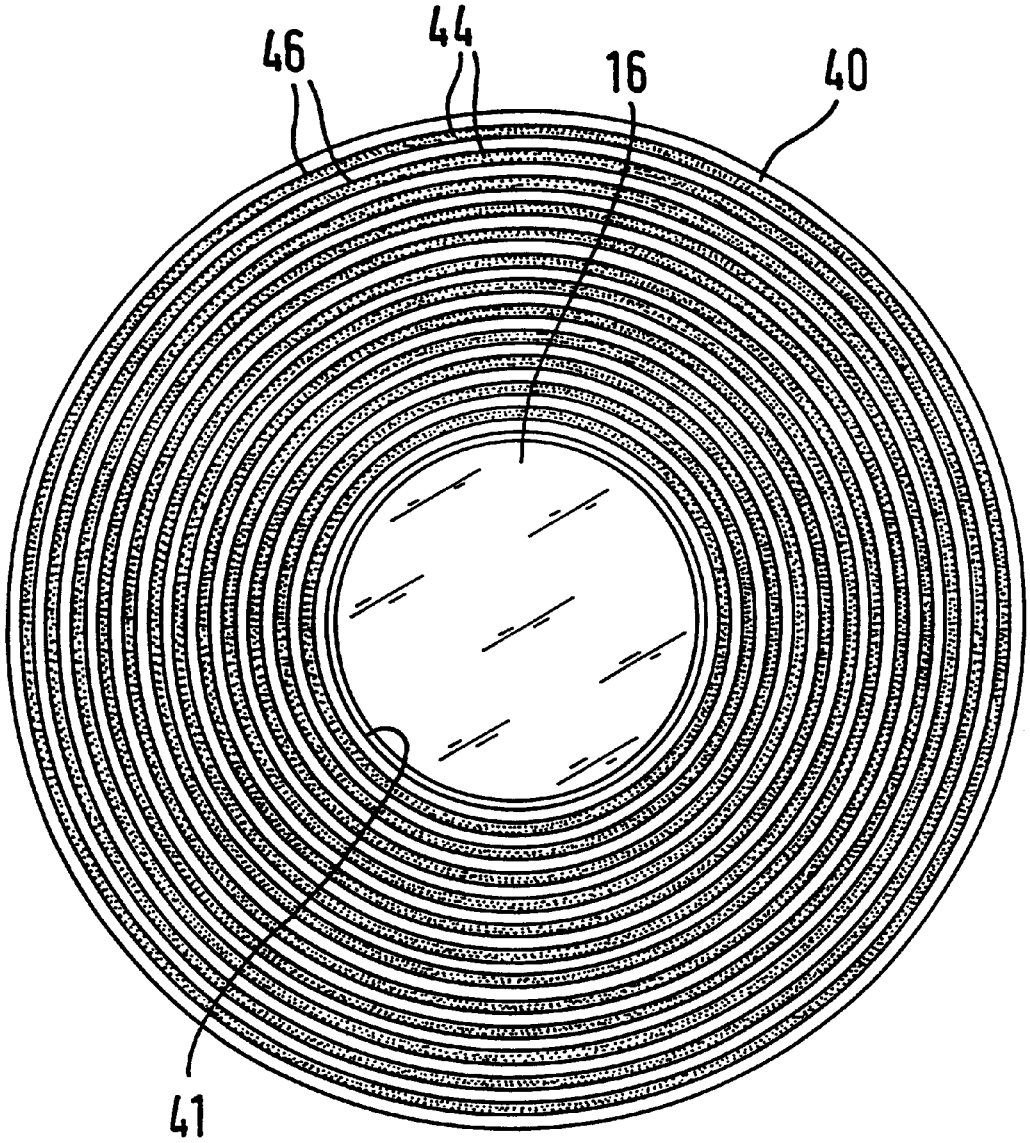
FIG. 4 is a view showing the headlight as considered in direction of the arrow 4 in FIG. 3.

Contrary to the preceding embodiment, the element 40 can be also truncated-cone shaped. The element 40 is therefore shaped so that its cross-section increases starting from the lens 16 in the light outlet direction 14 or opposite to the light outlet direction 14. In FIG. 4 the element 40 in accordance with the above described first, second and third embodiments is shown on a view opposite to the light outlet direction 14. The lens 16 has a round cross-section, and the element 40 surrounds the lens 16 over its entire periphery and is ring-shaped. The element 40 has a substantially round opening 41 for the lens 16 and a substantially round outer shape which however can be for example oval or cornered. It is also possible that the element 40 surrounds the lens 14 only over a part of its periphery and arranged for example only laterally near the lens 16 or only above and/or below the lens 16. The side of the element 40 facing in the light outlet direction 14 has the profiles 46 which are arranged over its total surface and formed as at least approximately concentric rings. The light passing through the element 40 is not substantially deviated by the profiles 46. The profiles 46, in contrast to the embodiments shown in FIG. 4 can extend in any other way, for example straight or curved.

The light passing through the element 40 provides an illumination of the element 40, so that the illuminated surface of the reflector is increased relative to the surface of the lens 16. The light passing through the element 40 also forms a light bundle additionally to the light bundle which passes through the light 16, so as to produce the dim light distribution. In the turned off condition of the headlight the light impinging from outside is reflected by the coating 44 at least partially, so that the element 40 has an approximately brilliant or reflecting appearance as reflector. When the optical profiles 42 for forming the Fresnel lens are arranged on the side of the element 40 facing the light outlet direction 14, the coating can be also applied on it.

In FIGS. 5 and 6, the element 40 is shown in accordance with a fourth embodiment, and is formed substantially as in the first embodiment. The element 40 facing the reflector 10 is provided with the optical profiles 42 for forming the Fresnel lens, and on its side facing in the light outlet direction 14 is formed with the profiles 56. The profiles 56 are wedge-shaped and at their side facing the light outlet direction 14 have increased flattenings 48 as shown in FIG. 6. The coating 44 is applied on the flattenings 48. It can be again reflecting, or partially reflecting and partially light-permeable. Due to the raised shape of the profiles 56 and their flattenings 58, the coating 44 can be applied in a simple manner, for example for by a printing or impregnating process, onto the flattenings 58. Without additional expenses, for example covering and other, the regions between the flattenings 58 can be left without the coating 44. With the wedge-shaped design of the profiles 56, the light passing through them is deviated. The arrangement and the design of the profiles 56 is selected so that this deviation of the passing light is performed with a predetermined intensity and in predetermined directions. The previously illustrated embodiments of the wedge-shaped profiles 56 can be provided also in the second and third embodiments of the curved element 40. Moreover, the profiles 42 which form the Fresnel lens can be arranged on the side of the element 40 facing in the light outlet direction and provided with the flattenings on which the coating 44 can be applied.

Figure 7:
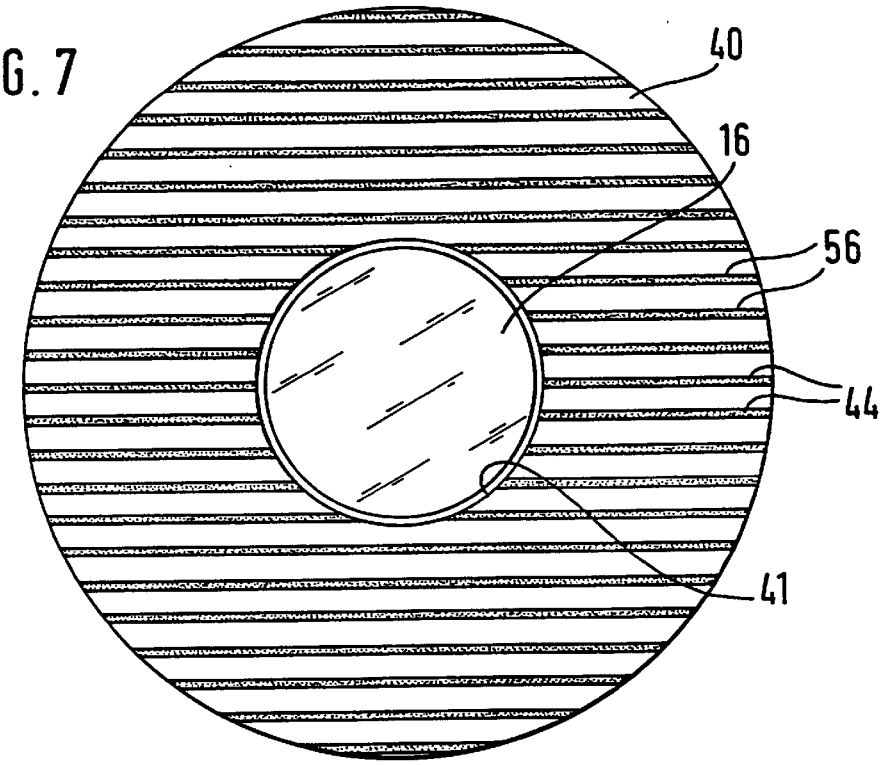
FIG. 7 is a view showing a portion of the headlight as seen in direction of the arrow 7 in FIG. 5.

FIG. 7 shows the element 40 in accordance with the fourth embodiment of the present invention in a view opposite to the light outlet direction 14. The element 40 surrounds the lens 16 which has a round cross-section over its entire periphery and has at least approximately round cross-section. The shape of the cross-section of the element 40 can also deviate from a round shape, and can be for example oval or rectangular. The side of the element 40 facing in the light outlet direction 14 is provided with profiles 56 formed as described hereinabove. In the embodiment of the element 40 in FIG. 7, they are linear and substantially horizontal. The light passing through the element 40 is deviated downwardly by the profiles 56. Due to this shape of the profiles 56, it is prevented that the light passing through the element 40 causes an extensive blinding, since it extends above the bright-dark limit of the dim light extending through the lens 16.

Figure 8:
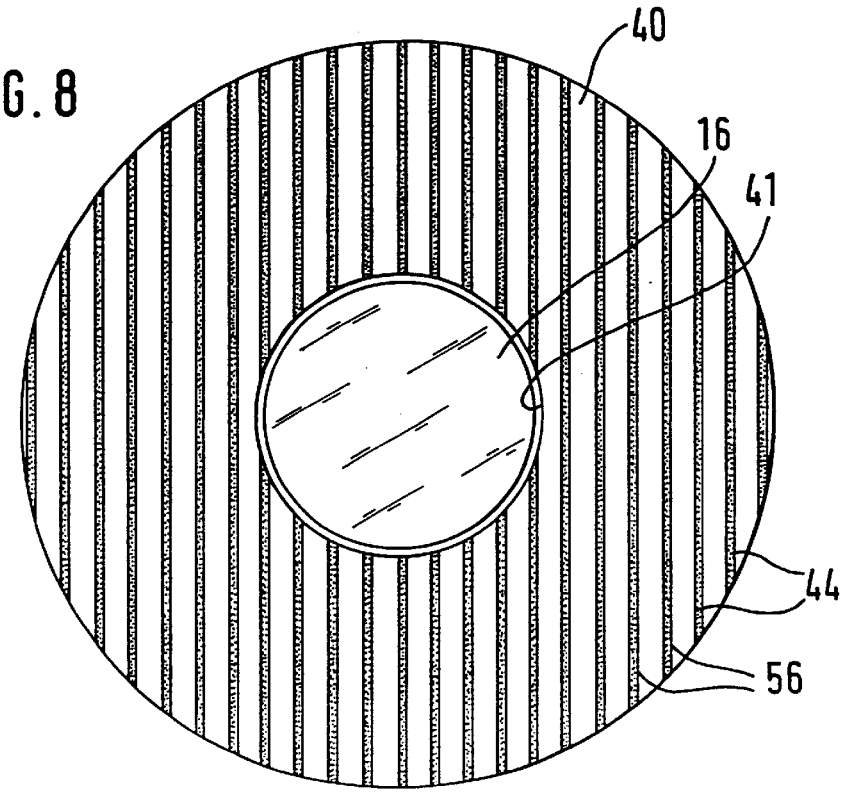
FIG. 8 is a view showing the headlight in accordance with the modified embodiment.

In FIG. 8 the element 40 is shown on the view opposite to the light outlet direction 14 in accordance with the modified embodiment. Here the profiles 56 are linear and extend substantially vertically. The light passing through the element 40 is deviated by the profiles 56 in a horizontal direction and thereby dispersed in the horizontal direction. Thereby blinding caused by the light passing through the element 40 is reduced, and moreover, a better visibility of the headlight from lateral directions is provided.

Figure 9:
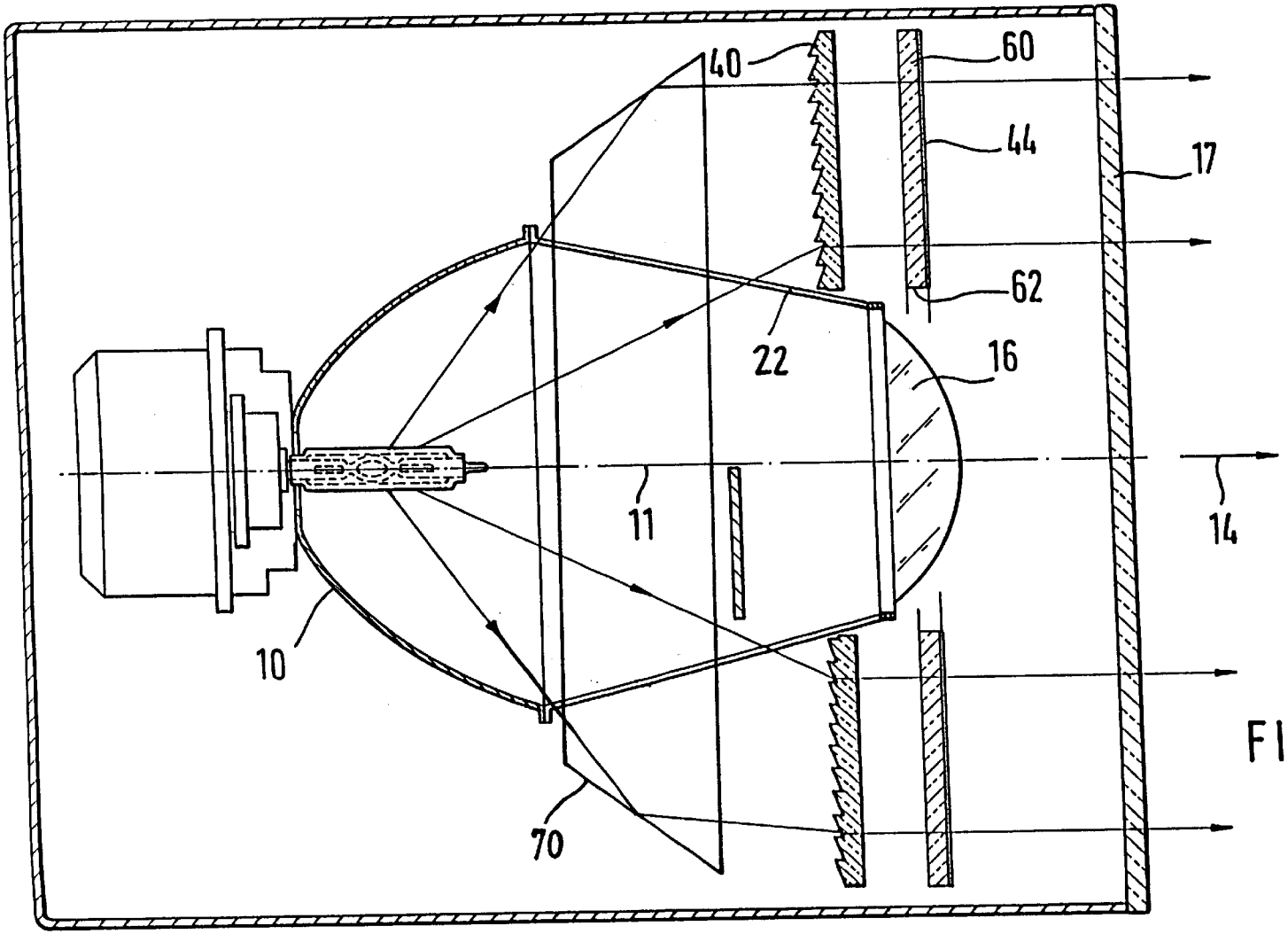
FIG. 9 is a view showing a headlight in a vertical longitudinal section in accordance with the fifth embodiment.

The headlight in FIG. 9 in accordance with a fifth embodiment substantially corresponds to the headlights of the previous embodiments. However, the coating 44 is applied here not on the element 40 contrary to the previous embodiments. A light permeable disk 60 arranged after the element 40 in the light outlet direction 14 is provided. It at least partially surrounds the lens 16 over a part of its periphery. The light passing through the lens 16 however does not pass through the disk 60. The disk 60 has an opening 62 provided for the unobjectionable passage of the light separated by the lens 16. The disk 60 is formed so that it extends at least over a part of the beam path of the light passing through the element 40 or through its total beam path. The coating 44 is applied at least over a region of the side of the disk 60 facing in the light outlet direction 14 and is formed at least partially reflective. The coating 44, as in the previous embodiment, can be provided in form of rings or lines on the disk 16, or adhere to the surface as a partially light permeable coating. The disk 60 can be smooth or provided at least on one side with at least local profiles formed so that the passing light is deviated by them. The coating 44 can be applied on the profile. The disk 60 as shown in FIG. 9, can be flat, however, it can be also concavely or convexly curved, or substantially conical. The disk 60 can have a substantially the same distance from the reflector 10 in direction of the optical axis 11 as the lens 16, or a different distance than the lens 16 and can be offset relative to the lens. The design of the headlight in accordance with the fifth embodiment makes possible in particular to arrange the element 40 relative to the lens 16 near the reflector 10 and to arrange the disk 60 in the region of the lens 16 or with a greater distance from the reflector 10 between the lens 16 and the cover disk 17. Thereby, the appearance of the headlight can be improved, since the coating 44 of the disk 60 is well visible from outside when looking in the headlight.

In the headlight in accordance with the fifth embodiment shown in FIG. 9, an additional reflector 70 is arranged between the reflector 10, and in particular its front edge facing in the light outlet direction 14, and the element 40. The additional reflector 70 extends at least over a part of the periphery of the reflector 10, for example substantially over the same periphery as the element 40. With the additional reflector 70, a part of the light which is emitted by the light source 12 and not captured by the reflector 10, is reflected so that this light passes at least partially through the element 40. The additional reflector 70 can be for example ring shaped and arranged around the front edge of the reflector 10. The additional reflector 70 in the axial longitudinal sections which contain the optical axis 11 can be flat, or can be concavely or convexly curved in any manner. The additional reflector 70 can be formed of one piece with the reflector 10 or can be held on it as a separate part. Alternatively, the additional reflector 70 can be held for example on the support element 20 or in any other way. Moreover, the light emitted by the light source 12 which is not captured by the additional reflector 70 can pass through the element 40. At least one additional reflector 70 formed as described hereinabove, can be also provided in the headlights of the first, second, third embodiments.

It will be understood that each of the elements described above, or two or more together, may also find a useful application in other types of constructions differing from the types described above.

While the invention has been illustrated and described as embodied in headlight for a vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A headlight for a vehicle, comprising a reflector; a light source; a lens through which light reflected by said reflector passes; a supporting element extending between said reflector and said lens and holding said lens; at least one element which surrounds said lens at least over a part of a periphery thereof and is at least partially light permeable; said supporting element having at least one opening formed such that light emitted by said light source and not captured by said reflector passes directly there-through, and said at least one element being provided with ring-shaped optical profiles so that the light passing through said at least one opening of said supporting element passes through said at least one element and is collected; and a partially reflecting layer facing a light outlet direction and arranged only in a beam path of the light which passes through said at least one element.

2. A headlight as defined in claim 1; and further comprising a light permeable disk arranged after said element in the light outlet direction and having a side facing the light outlet direction, said layer being formed as a coating arranged on said side of said disk and surrounding said lens at least over a part of its periphery.

3. A headlight as defined in claim 2, wherein said coating is partially reflective and partially light permeable.

4. A headlight as defined in claim 1, wherein said element has a side which faces a light outlet direction and away from said reflector, said layer being formed as a coating applied on said side of said element.

5. A headlight as defined in claim 1, wherein said element is formed as a substantially flat element.

6. A headlight as defined in claim 1, wherein said element is formed as a substantially curved element.

7. A headlight as defined in claim 1, wherein said element has a side facing in a light outlet direction and away from said reflector and is provided with raised profiles on said side; and further comprising at least partially reflective coating applied on said profiles.

8. A headlight as defined in claim 7, wherein said profiles have flattenings which face in the light outlet direction, said coating being applied on said flattenings.

9. A headlight as defined in claim 7, wherein said profiles extend over said element in a ring-shaped manner.

10. A headlight as defined in claim 7, wherein said profiles are at least substantially straight and at least substantially horizontal.

11. A headlight as defined in claim 7, wherein said profiles are at least substantially straight and at least substantially vertical.

12. A headlight as defined in claim 7, wherein said profiles are formed so that a light which passes through said profiles is deviated.

13. A headlight as defined in claim 1, wherein said layer is formed as a coating selected from the group consisting of a printed coating and an impregnated coating applied on said element.

14. A headlight as defined in claim 1, wherein said coating is formed as a coating selected from the group consisting of a printed coating and an impregnated coating applied on said disk.

15. A headlight as defined in claim 1; and further comprising at least one additional reflector which is arranged between said first mentioned reflector and said element so that the light which is emitted by said light source and not captured by said reflector is at least partially reflected by said additional reflector and passes through said element.

* * * * *